United States Patent [19]

Alexander

[11] 4,384,798

[45] May 24, 1983

[54] MANUALLY POSITIONABLE CORRECTION MEDIA HOLDER AND DISPENSING APPARATUS

[75] Inventor: James S. Alexander, Paris, Ky.

[73] Assignee: International Business Machines Corporation, Armonk, N.Y.

[21] Appl. No.: 273,557

[22] Filed: Jun. 16, 1981

[51] Int. Cl.[3] ..... B41J 29/36

[52] U.S. Cl. ..... 400/697.1

[58] Field of Search ..... 400/697.1, 536

[56] References Cited

U.S. PATENT DOCUMENTS 3,834,512 9/1974 Haugen ..... 400/697.1

OTHER PUBLICATIONS

IBM Technical Disclosure Bulletin, vol. 21, No. 12, May 1979 "Cardholder-Ribbon Guide Combination for Printers", pp. 4744-4746.

*Primary Examiner*—Edgar S. Burr
*Assistant Examiner*—Charles Pearson
*Attorney, Agent, or Firm*—Laurence R. Letson

[57] ABSTRACT

A cardholder of a single element moving carriage typewriter may be modified to accept and accurately position with respect to the print point of the typewriter a correction media holder so that a correction operation may be performed correcting erroneously typed characters. The correction media holder is configured to mate in a precise condition with the modified cardholder and to support a supply and takeup spool of correction media on the holder as well as to cause the deflection of the correction media as it traverses across the region of the print point to present the active or operative face of the correction media to a printed page.

9 Claims, 2 Drawing Figures

MANUALLY POSITIONABLE CORRECTION MEDIA HOLDER AND DISPENSING APPARATUS

BACKGROUND OF THE INVENTION

The correction of errors by typists has been a continuing problem for as long as typewriters have existed and the most common technique for correcting errors made by a typist is to use a small slip of correction material positioned and hand-held between the typing ribbon and printed page to cover up or camouflage the error. More recently, hand-held adhesive tabs which may be utilized in much the same way act to adhere to and remove the typed image from the page when the image has been typed with a specially formulated correctable ribbon.

The use of hand-held slips or tabs is generally quite inefficient since they are difficult to insert between the printing ribbon and the printed page, difficult to hold in that position while typing, particularly for multiple corrections, and subject to requiring a multiple correction effort if the portion of the correction material used has been previously used.

Automated correction of typing errors has been accomplished in recent years by the introduction of correcting typewriters such as the IBM Correcting SELECTRIC typewriter which solves many of the above problems but provides a solution to such problems only upon those dedicated typewriters which were designed and built to be correcting typewriters.

There exists a large number of typewriters such as the IBM SELECTRIC typewriter having a moving print carriage which do not have the automated correcting capability and which still have a significant useful life remaining. These typewriters and their operators will benefit from some efficient form of error correction.

U.S. Pat. No. 3,834,512 to Dorothy E. Haugen discloses an apparatus for converting a typebar typewriter of conventional construction into a typewriter having the capability of improved correction. This device is permanently mounted on the typewriter to position a span of correction material in proximity to the print point and includes a device for effecting the raising of the span of correction material to a point to where it traverses the print point for correction.

This device is cumbersome in that it requires a substantial amount of space on either side of the print point which cannot be interfered with at any time during the operation of the machine.

SUMMARY OF THE INVENTION

The correction media holder is fabricated such that it is repeatably positionable at a point where the correction media, in the form of a tape or web, will traverse the print point of the typewriter and, at the same time, be easily removable by the operator upon the completion of the correction operations to not impede the typewriter operations. The correction media holder further defines locating surfaces to insure proper location of the span of correction media as it traverses the print point. The holder is formed to accommodate the supply and takeup spools of commercially available correction media and permit the manual winding of the correction media from the supply to the takeup spool. The holder is adapted for manual insertion and engagement with locating and positioning members and surfaces which are attached to or formed as a part of the cardholder of the typewriter.

The device may be inserted and removed easily by the operator and, thus, not encumber areas extending outward from the print carrier which must, during at least some portions of the periods of the operation of the typewriter, remain unencumbered. The correction media holder is adapted such that it will accommodate the supply and takeup spools of commercially available coverup and lift-off tape materials such as that sold by IBM Corporation as IBM Cover Up Tape and IBM Lift-off Tape, presently for use on the IBM Correcting SELECTRIC Typewriter and other related IBM correcting typewriters.

DESCRIPTION OF THE INVENTION

Figure 1:
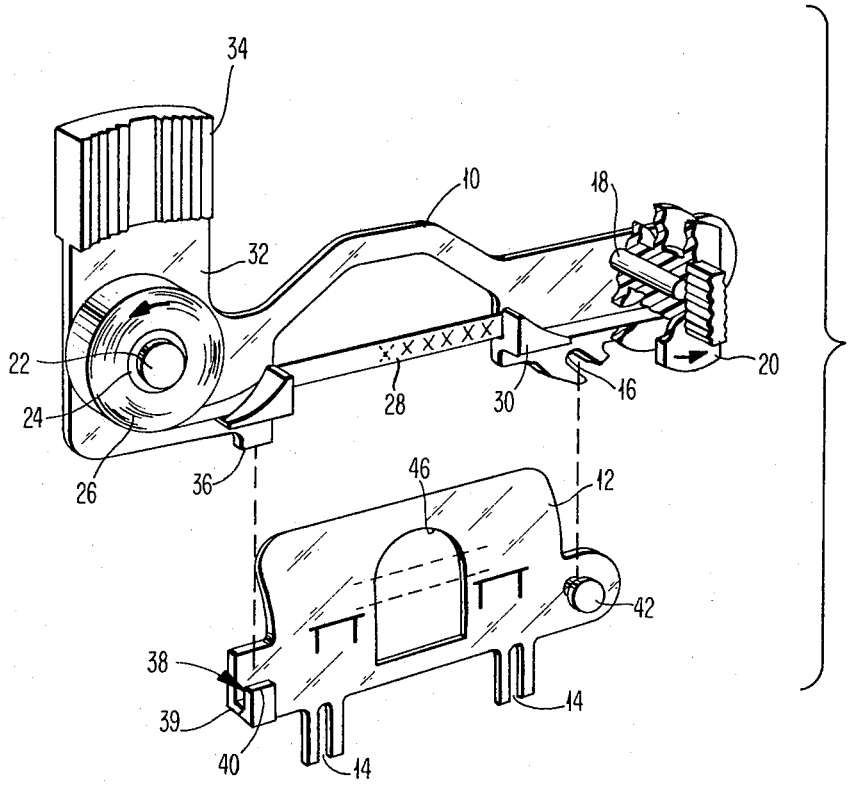
FIG. 1 illustrates the correction media holder displaced from the cardholder with which it cooperates when inserted into the typewriter.

Referring to the drawing, the correction media holder 10 is illustrated as being displaced from the cardholder 12. Cardholder 12 is mountable on the typewriter by means of slots 14 which may be engaged with fastening devices in the typewriter and particularly on the print carriage of the typewriter. Other snap-in, snap-out features of the cardholder may be incorporated to ease insertion and removal of the cardholder from the typewriter if desired. Correction media holder 10 is provided with a locating surface 16 which can be formed into the correction media holder 10 by molding into the structure, the recess 16 or slot 16, or may be made by stamping if the holder 10 is made of a stamped material.

The correction media holder 10 is further configured with a stub shaft 18 upon which a takeup spool 20 may be rotatably supported. Takeup spool 20 is useful to accumulate the used or consumed correction media 26. Stub shaft 22 is likewise fixedly attached to or formed as a part of the correction media holder 10 to permit the supply spool 24 to be rotatably inserted thereon.

The correction media 26 is unreeled as a supported span 28 across the opening formed by the correction media holder 10. The span 28 is oriented such that the active surface of the correction media 26, either a camouflaging material or adhesive material, is oriented toward the platen 50 by deflecting members 30. Deflecting members 30 act to cause the deflection from its normal path into a path with the desired side parallel to the platen 50 and then to be allowed to deflect back to be accumulated on the takeup spool 20. An upstanding portion 32 of correction media holder 10 is provided and may be provided at any point on the holder 10 easily grasped by the operator. Finger gripping serrations 34 are illustrated on upstanding portion 32 to improve the grip.

Correction media holder 10 is also provided with a positioning abutment member 36 extending downwardly from holder 10 to engage the bottom portion of slot 38 formed as part of cardholder 12. Slot 38 is formed by an upright portion 40 oriented substantially parallel to the face of cardholder 12 and having a bottom member 39 forming slot 38. This acts to not only position abutment surface 36 relative to the cardholder, but also to constrain the correction media holder 10 in parallel relationship to the face of the cardholder 12. The bottom of slot 38 acts as a positioning stop means.

A locating means 42 or support pin 42 is located on the opposite end of cardholder 12. Positioning surface 16 is engageable with pin 42 for insertion of the correction media holder 10 into the typewriter 44. With positioning surface 16 in engagement with pin 42 and abutment surface 36 in engagement with the bottom of slot 38, the span 28 of correction media 26 extends across the opening 46 of cardholder 12 and traverses the print point of typewriter 44.

The incrementing of the consumed or used correction media 26 is accomplished by the turning of takeup spool 20 either before insertion or after removal to position unused correction media 26 at the print point 52.

Figure 2:
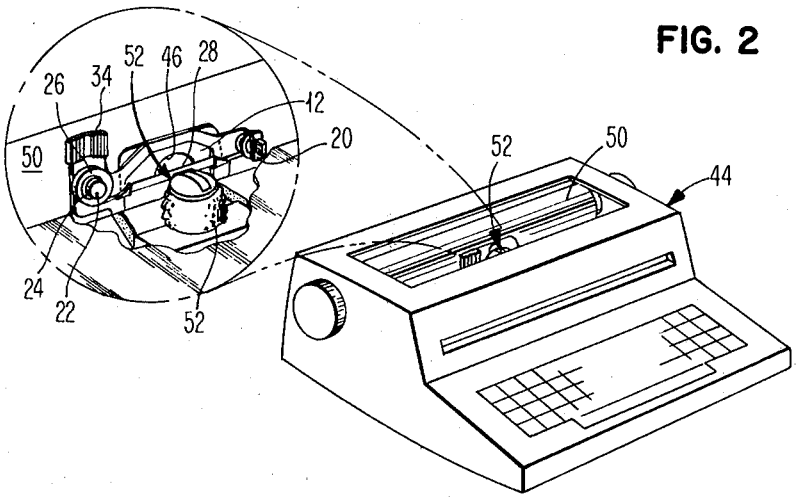
FIG. 2 illustrates the relative positioning of the correction media holder with respect to the cardholder and the print element of a typewriter.

Referring to FIG. 2, the spools 20 and 24 are illustrated carrying the correction media 26 thereon and suspending span 28 across the opening 46 of cardholder 12. The spools are rotatable on shaft 22 and shaft 18 illustrated in FIG. 1.

Upstanding portion 32 with serrations 34 extends sufficiently above the surrounding mechanical equipment such as the platen 50 and type element 52 as to permit easy grasping by the operator for removal and/or insertion.

Spools 24 and 20, together with their respective wrappings of correction media 26, are positioned sufficiently outboard from the print point as to allow the normal ribbon lift mechanism of the typewriter to be raised and lowered to allow the typewriter to function properly during the correction operation which involves the retyping of the erroneous character with the correction media span 28 intermediate the printing ribbon and/or printing element 52 and the image on the typing page supported by platen 50. After the correction has been made and the print carrier and print element 50 repositioned for printing the correct character, the correction media holder 10 may be removed and by a partial twisting of the takeup spool 20 in a counterclockwise direction cause the used portion of the correction media 26 to be incremented across the span 28 to provide unused material in the region of the print point 52.

The correction media utilized may be either a camouflaging cover-up material which may be used with either a fabric ribbon or with a film ribbon or may be a material having an adhesive or tacky surface such that it adheres to a specially formulated correctable ribbon and removes the image from the page.

I claim:

1. In combination with a typewriter having a print point, a locating means spacially fixed with respect to said typewriter print point;

a positioning stop means spacially fixed with respect to said print point;

a manually temporarily insertable and removable holding member locatingly engageable with said locating means and positionally engageable with said positioning stop means, said holding member being inserted when error correction is desired and being removed upon completion of desired corrections and removed from said typewriter during printing operations;

said holding member further comprising support means for supporting and accommodating a spool of correction media and a takeup spool for accumulating used correction media, said support means configured to extend a span of said media past and overlying said print point at all times when said holding means is inserted into engagement with said locating means and positioning stop means.

2. The apparatus in combination with a typewriter of claim 1 wherein said locating means comprises a pin and positioned to receive said holding member.

3. The apparatus in combination with a typewriter as in claim 1 wherein said typewriter further comprises a cardholder and said locating means is fixedly positioned relative to said cardholder.

4. The apparatus of claim 3 wherein said locating means is a pin extending substantially perpendicular to the cardholder and mounted thereon.

5. The apparatus in combination with a typewriter of claim 1 wherein said support means comprises a pair of spaced apart shafts for receiving supply and takeup spools.

6. The apparatus of claim 1 wherein said support means further comprises means for orienting said correction media in a desired plane during passage across said span.

7. The apparatus of claim 6 wherein said means for orienting said correction media comprises a deflecting surface for deflecting said media to position one surface of said media approximately parallel with said cardholder.

8. The apparatus of claim 2 wherein said apparatus further comprises a locating surface for engagement with said pin.

9. The apparatus of claim 8 wherein said locating surface is a slot engageable with said pin.

* * * * *